US005890845A

United States Patent [19]

Buonaiuto, Sr. et al.

[11] Patent Number: 5,890,845

[45] Date of Patent: Apr. 6, 1999

[54] METHOD AND MEANS FOR SEALING CRAWLSPACE SURFACES

[75] Inventors: Frank V. Buonaiuto, Sr., New Milford; Anthony B. Buonaiuto, Brookfield, both of Conn.

[73] Assignee: FTF Crawlspace Specialists, Inc., New Milford, Conn.

[21] Appl. No.: 741,354

[22] Filed: Oct. 29, 1996

Related U.S. Application Data

[63] Continuation-in-part of Ser. No. 565,236, Nov. 30, 1995, abandoned.

[51] Int. Cl.[6] ..... E02D 3/12

[52] U.S. Cl. ..... 405/268; 405/266

[58] Field of Search ..... 405/229, 250, 405/263, 266, 270, 267, 268; 52/169.14, 169.5, 169.11, 741.41, 741.4

[56] References Cited

U.S. PATENT DOCUMENTS

| | | | |
|---|---|---|---|
| 2,176,891 | 10/1939 | Crom | 405/268 X |
| 3,731,493 | 5/1973 | Stevens | 405/263 |
| 4,510,180 | 4/1985 | Cornely et al. | 405/266 X |
| 5,002,438 | 3/1991 | Strong | 405/268 X |
| 5,054,252 | 10/1991 | Newman | 52/169.14 |

OTHER PUBLICATIONS

Zonolite Vermiculite Lightweight Insulating Concrete Chemgrout, by Chemgrout, La Grange Park, Illinois.

*Primary Examiner*—Tamara L. Graysay
*Assistant Examiner*—Frederick L. Lagman
*Attorney, Agent, or Firm*—Ware Fressola Van Der Sluys & Adolphson LLP

[57] ABSTRACT

A method of sealing the entire surfaces of a crawlspace and other areas difficult to access in a structure is set forth in which a uniformly thick layer of a quick drying and moldable lightweight concrete is flowed over the entire surfaces to be covered in a uniform thickness sufficient to seal the surface.

8 Claims, 3 Drawing Sheets

METHOD AND MEANS FOR SEALING CRAWLSPACE SURFACES

The present application is a Continuation-In Part of application, Ser. No. 08/565,236, filed Nov. 30, 1995, now abandoned and this earlier filing date is hereby claimed for all parts of such earlier application being in common with the present application.

The present invention relates to construction generally and, more particularly, but not by way of limitation, to novel methods and means for sealing crawlspace surfaces and surfaces of other such areas in structures which are difficult to access, especially those areas of dirt under dwellings.

BACKGROUND OF THE INVENTION

A crawlspace in a structure is typically an area having low headroom and underlying a main portion of the structure. Typically, crawlspaces are provided, rather than a full basement structure, to reduce the cost of the structure. Since reduction of cost is an objective of such construction methods, the surface of the crawlspace is usually left unsealed and is, simply, a dirt surface.

Such unsealed dirt surfaces have a number of disadvantages. These include the promotion of dry rot in the wood members of the overlying structure and the provision of a hospitable climate for mildew, mold, and fungus which can adversely affect wallpaper, paint, and cloth materials beyond restoration and which can create unhealthy living conditions for occupants of the structure. Furthermore, resulting dampness and musty odor create uncomfortable living conditions and an unpleasant scent. Allergies can be aggravated by pollen and/or dust being circulated from the crawlspace through the ventilation system in the structure. Radon gas can easily enter the structure through the dirt surface of the crawlspace. Additionally, such crawlspaces are breeding grounds for a variety of vermin, rodents, and insects which are nuisances and which also pose health problems. Another disadvantage of an unsealed crawlspace is that heat is readily lost to the dirt surface. Even when sealed with conventional structural concrete mixtures, the heat loss problem is not greatly reduced. Also, structural concrete is somewhat porous and does not eliminate moisture.

In spite of the above disadvantages of unsealed crawlspaces, many remain in that condition because of the difficulty and expense of sealing the surfaces of the crawlspaces. This is because the only known method of sealing such spaces is to place a layer of structural concrete on the surface, but this is often very difficult and expensive using conventional techniques since accessibility and headroom are restricted by such crawlspaces and the conventional heavy structural concrete cannot be placed using conventional equipment, such as chutes and wheelbarrows. In some cases, pushing heavy buckets of concrete across the dirt surface and then dumping them, is the only procedure by which concrete can be placed. In other such cases, the interior of the structure and fixtures, as well as furniture therein, may be damaged if the structural concrete must be hauled through the interior of the structure to reach an access opening to the crawlspaces. Sometimes, the placement of the structural concrete results in unavoidable and/or unintentional damage to landscaping around the structure.

A further problem in the dispatch of conventional, structural concrete, especially on non-level surfaces of the crawlspace, is the flowing of the concrete after pouring to the lowest spot or levels. This leads to problems in areas of the crawlspace that remain uncovered, or have an insufficient amount of concrete covering on the ground surface.

SUMMARY OF THE INVENTION

Accordingly, it is a principal object of the present invention to provide a new method and means for easily sealing the surfaces of crawlspaces using an unconventional concrete material.

It is a further object of the invention to provide such new method which can employ available equipment and materials.

It is an additional object of the invention to provide such method and means which are economical.

It is another object of the invention to provide such method and means which prevents and reduces dampness, thereby accomplishing substantial heat loss reduction.

It is a still further object of the present invention to provide a concrete sealant to a crawlspace surface which forms a uniform layer to a given thickness, resulting in an enhanced sealant that accomplishes protection from natural pollutants, as well as from Nature's creatures.

It is again another object of the present invention to provide such a concrete sealant of a lightweight material, such as to be easily handled and inserted into crawlspaces.

It is a particular object of the present invention to provide a process from which the entire house and household benefits because of enhanced living conditions due to the reduction of moisture and pollutants in the home.

The present invention achieves these objects, among others, by providing a technique for uniformly sealing the surfaces of crawlspaces in which a substantially uniformly thick layer of a lightweight concrete material, having a weight substantially less than conventional concrete materials, is applied to such surfaces. In this respect the lightweight concrete material has a density ranging from about one-fifth to about one-sixth of the density of conventional concrete materials. Such a lightweight concrete material has been found to have substantially greater insulation values than conventional materials, and has been found to achieve water repellency necessary for forming dry crawlspace areas.

The technique of the present invention can be carried out with conventional machinery in which the lightweight concrete material is pumped into the crawlspaces through a flexible hose, thereby eliminating the destructive problems of conventional techniques and materials. The concrete material used in the present invention is not only lightweight and water repellent, but also cures rapidly with a short drying time and is sufficiently flowable to follow the curves and contours of the surface on which it is applied. This latter feature enables the layer to form in a uniform thickness over the entire surface of the crawlspace.

BRIEF DESCRIPTION OF THE DRAWING FIGURE

An understanding of the present invention and the various aspects thereof will be facilitated by reference to the accompanying drawing figure, submitted for purposes of illustration only and not intended to define the scope of the invention, in which.

DESCRIPTION OF THE INVENTION

Figure 1:
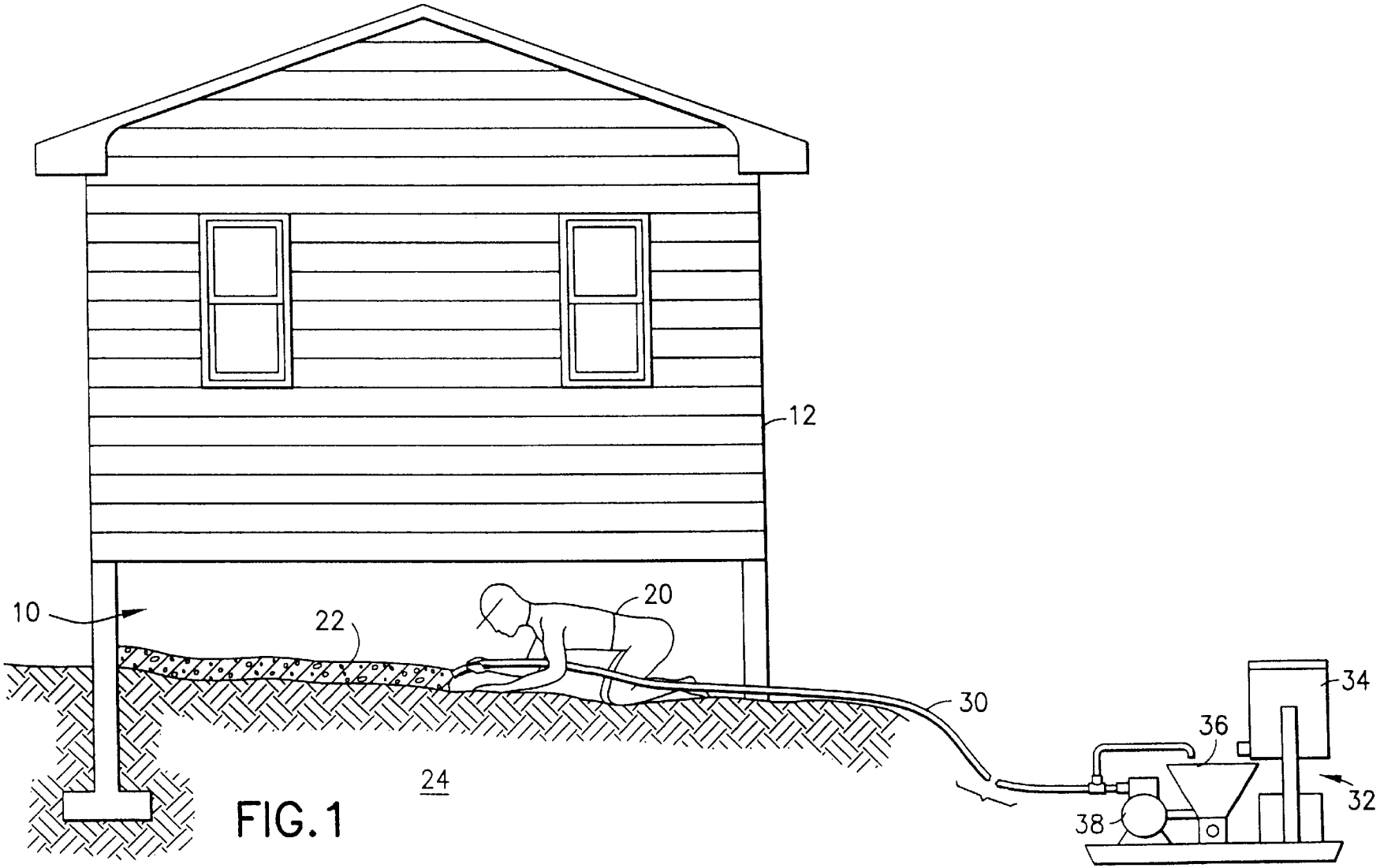
FIG. 1 is a side elevational view, partially in cross-section, illustrating a crawlspace surface being sealed by the method of the present inventions.
Figure 2:
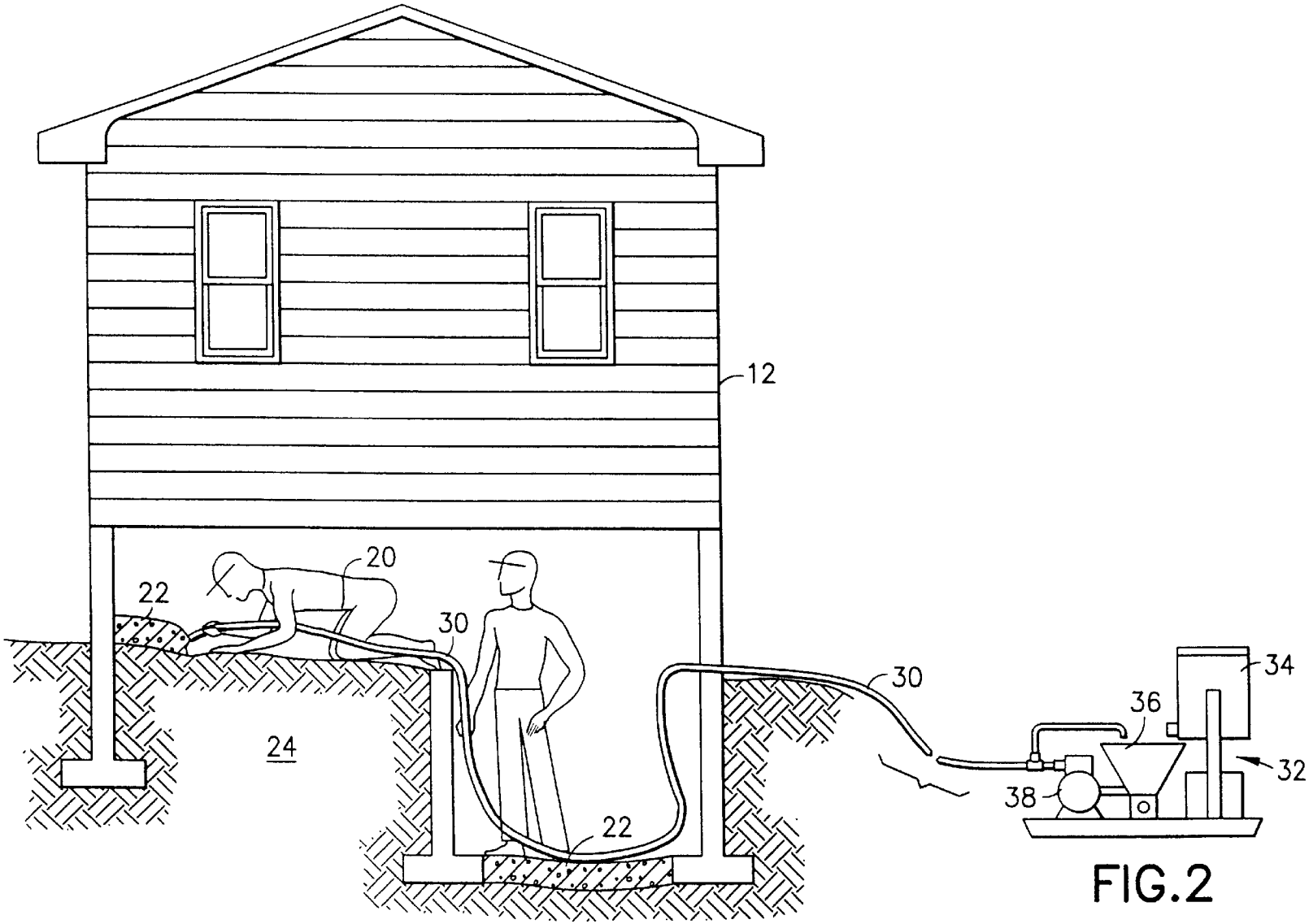
FIG. 2 shows a crawlspace with a partial basement sealed according to the present invention.
Figure 3:
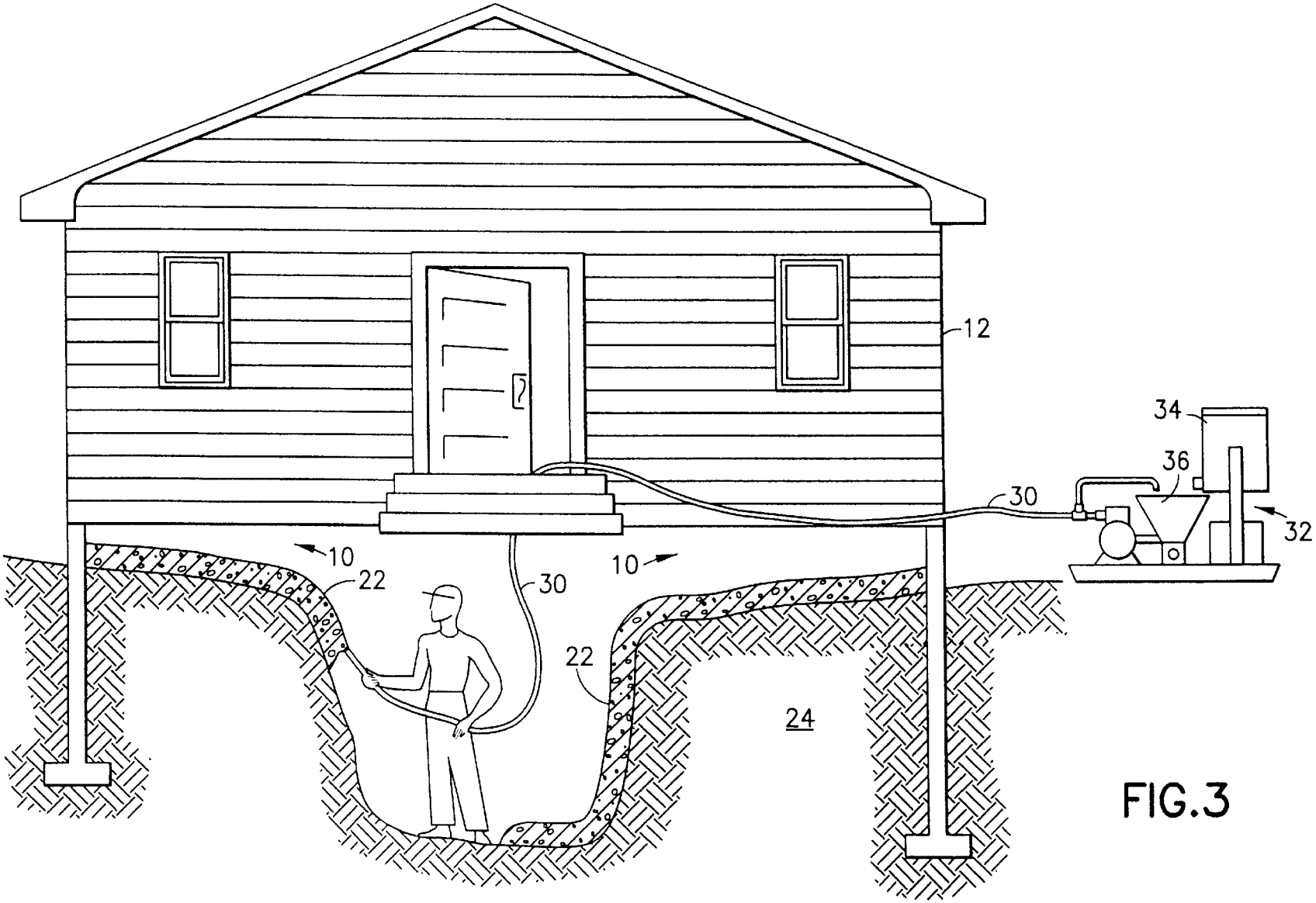
FIG. 3 shows a crawlspace having an access-way in which the ground is being sealed.

Reference should now be made to the drawing figure wherein a crawlspace 10 under a structure 12 is being sealed by the method of the present invention. It can be seen that crawlspace 10 has very low headroom and that conventional methods of placing concrete on the surface of the crawlspace would be impossible to employ. In many cases of such home construction in the United States, the structure of the house is only inches above the ground.

By the present invention, a worker 20 can place a layer of a lightweight concrete material 22 on a dirt flooring which forms the surface of the crawlspace 10. A layer of only about three inches in thickness is sufficient to accomplish the health and effectiveness of the present invention. Debris has previously been removed from crawlspace 10 and dirt 24 has previously been given a rough leveling. While the dirt surface has been generally leveled, it still may have portions of the total area which are substantially at different levels in height with sloping features of the surface. After a sheet of a polymeric material, such as polyethylene, of about 0.006 inches in thickness has been laid over the surface, a lightweight concrete is flowed over the surface to a thickness of generally about three inches. This lightweight concrete material 22 flows over the surface in a near finished form. It can be given a trowel finish to smooth it out, but the material generally flows over the surface whether uphill or down in a fairly uniform thickness, so that it solidifies in a near perfect finish and overall thickness.

The worker 20 directs the flow of the lightweight concrete 22 on the dirt 24 by way of an easily handled, two-inch diameter, flexible hose 30 connected to a skid-mounted grout pump and mixer system, generally indicated by the reference numeral 32. System 32 includes a mixing tank 34, a pump hopper 36 which receives mixed materials from the mixing tank, and a pump 38 which receives the material from the pump hopper and provides pressurized mixed, lightweight concrete material through the hose 30. While the system 32 may be any mechanism for pumping thickened material through a hose, in practice the present invention has used a Model CG-550 "Skid-Mounted, Self-Contained Grout Pump & Mixer System", such as provided by ChemGrout, LaGrange Park, Ill., or a "3024-6S Hydraulic Thick Mix Plant", supplied by Cambrian Equipment Co., King of Prussia, Pa.

The lightweight concrete material 22 is a mixture having a dry density of about 22–28 pounds per cubic foot, or about one fifth to about one sixth the density of conventional concrete mixtures. The lightweight concrete mixture may be provided from a mixture of dry components of the concrete material with a solvent, such as water. The lightweight mixture may be provided by mixing conventional cement with vermiculite, and a usable mixture consists of about 1 bag of cement to about six cubic feet of vermiculite with about 15–30 gallons of water, depending on the consistency and handling of the mixture desired. A mixture of Zonolite vermiculite, for example, may be obtained as "Zonolite Vermiculite Lightweight Insulating Concrete" from W.R. Grace & Co., New York, N.Y. This lightweight concrete material is flowable, maintains its shape, and has an insulation value of about 1.49 per inch of thickness, or about 5 to 6 for the thicknesses of the present invention, which is about 20 times greater then conventional concrete, and greatly reduces the heat loss to dirt 24 in the crawlspace.

It has been found that the lightweight concrete material used in the present invention has the characteristics of flowability, moldability, and workability. That is, one can work with the material immediately upon pouring, whereas ordinary concrete requires a setting time of about 45 minutes before it can be worked. This enables immediate molding of the concrete by the present invention so that areas of different levels, or hilly ground, can be uniformly covered to the same thickness of about three inches. Sometimes in the practice of the present invention the dry mixture of the concrete may have limestone added to strengthen the finished product in which case the amount of water or solvent is varied to approximately 26 gallons of water. Otherwise, the water in the mixture may be varied to cause the concrete material to have different characteristics of flowability and moldability. The important aspect of the present invention is to be able to mold the concrete layer as to thickness and uniformity of thickness.

This process of the present invention creates a dry, clean, and usable storage area in the crawlspace in which mildew, rodents, and insects can no longer thrive. The ingress of Radon is substantially eliminated, or greatly reduced, thereby creating an enviromentally effective safety feature. The process is economical and can easily and rapidly be employed by two or three workers. The process can be carried out without any damage to landscaping or to internal housing fixtures or furniture, since only a small diameter hose is needed to convey the lightweight concrete to the crawlspace.

It will thus be seen that the objects set forth above, among those elucidated in, or made apparent from the preceding description, are efficiently attained and, since certain changes may be made in the above construction without departing from the scope of the invention, it is intended that all matter contained in the above description or shown on the accompanying drawing figure shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What we claim:

1. A method of sealing exposed earthen surfaces in spaces under a structure which are not conveniently accessible such as crawlspaces and the like, comprising the steps of mixing one part by volume of dry cement with about four to about seven parts by volume of a light dry granular aggregate, producing a dry mixture;

adding to the resulting dry mixture from about two parts by volume to about four parts by volume of a liquid solvent, producing a lightweight, flowable, workable, moldable concrete, pumping the newly mixed flowable concrete through a manually maneuverable flexible hose to deliver it in turn to all parts of said exposed earthen surfaces;

whereby said exposed earthen surfaces are covered by a layer of quick-curing, quick-drying concrete having less than one-fifth the density of conventional concrete, achieving substantially greater insulation values than conventional concrete achieves, and having substantially uniform thickness.

2. A method according to claim 1, wherein said lightweight concrete material is formed with a density ranging from about one-fifth to about one-sixth of the density of said conventional concrete material.

3. A method according to claim 2, further comprising, before said step of applying, the further steps of (a) roughly leveling said surfaces, and (b) providing a polymeric sheet on said roughly leveled surfaces.

4. A method according to claim 3, wherein said polymeric sheet is provided by a sheet of polyethylene of about 0.006 inches in thickness.

5. A method according to claim 1, wherein said mixing is carried out by forming a mixture of cement and vermiculite.

6. A method according to claim 1, wherein said solvent is water and wherein said mixing is carried out by adding one bag of cement to about six cubic feet of vermiculite with from about 18 to about 20 gallons of water.

7. A method according to claim 1, wherein said substantially uniform thick layer of lightweight concrete material is formed at a layer thickness averaging about 3 inches.

8. A method according to claim 1, wherein said step of applying is carried out to flow said lightweight concrete material entirely over the exposed earthen surface area of said crawlspace and other areas difficult to access.

* * * * *